US010837670B2

(12) United States Patent
Tezuka et al.

(10) Patent No.: US 10,837,670 B2
(45) Date of Patent: Nov. 17, 2020

(54) AIR-CONDITIONING APPARATUS

(71) Applicant: Mitsubishi Electric Corporation, Tokyo (JP)

(72) Inventors: Motoshi Tezuka, Tokyo (JP); Nobutaka Tanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 51 days.

(21) Appl. No.: 16/300,222

(22) PCT Filed: Aug. 9, 2016

(86) PCT No.: PCT/JP2016/073434
§ 371 (c)(1),
(2) Date: Nov. 9, 2018

(87) PCT Pub. No.: WO2018/029783
PCT Pub. Date: Feb. 15, 2018

(65) Prior Publication Data

US 2019/0154291 A1 May 23, 2019

(51) Int. Cl.
*F24F 11/65* (2018.01)
*F24F 11/30* (2018.01)
(Continued)

(52) U.S. Cl.
CPC ..... *F24F 11/65* (2018.01); *F24F 11/30* (2018.01); *F24F 2110/10* (2018.01); *F24F 2110/12* (2018.01); *F24F 2120/10* (2018.01)

(58) Field of Classification Search
CPC ..... F24F 11/65; F24F 11/30; F24F 2110/10; F24F 2110/12; F24F 2120/10;
(Continued)

(56) References Cited

U.S. PATENT DOCUMENTS 4,333,316 A * 6/1982 Stamp, Jr. ..... F25B 13/00 62/126
4,381,549 A * 4/1983 Stamp, Jr. ..... F24D 19/1039 62/126
(Continued)

FOREIGN PATENT DOCUMENTS

CN 102597641 A 7/2012
EP 2 484 986 A1 8/2012
(Continued)

OTHER PUBLICATIONS

International Search Report of the International Searching Authority dated Sep. 13, 2016 for the corresponding international application No. PCT/JP2016/073434 (and English translation).
(Continued)

*Primary Examiner* — Jianying C Atkisson
*Assistant Examiner* — Jose O Class-Quinones
(74) *Attorney, Agent, or Firm* — Posz Law Group, PLC

(57) ABSTRACT

An air-conditioning apparatus according to an embodiment of the present invention includes: a heating device configured to perform a heating operation by heating air inside a room and sending out the heated air; a floor temperature sensor configured to measure a floor temperature inside the room; a suction air temperature sensor configured to measure a suction air temperature that is a temperature of the air flowing into the heating device; and a controller configured to calculate a reference temperature from the floor temperature and the suction air temperature, and when determining that the reference temperature is lower than a start determination temperature designated in advance, cause the heating device to perform the heating operation.

10 Claims, 7 Drawing Sheets

(51) Int. Cl.
*F24F 110/12* (2018.01)
*F24F 120/10* (2018.01)
*F24F 110/10* (2018.01)

(58) Field of Classification Search
CPC ..... F24F 11/66; F24F 1/0003; F24F 1/022; F24F 1/0373; F24F 5/001; F24F 11/873
See application file for complete search history.

(56) References Cited

U.S. PATENT DOCUMENTS 4,697,430 A * 10/1987 Toyoda ..... G05D 23/1917 62/209
5,568,733 A * 10/1996 Toyota ..... G05D 23/1905 62/228.4
5,588,589 A * 12/1996 Ishihara ..... F24F 11/0009 165/267
5,815,078 A * 9/1998 Mun ..... F24F 11/79 340/573.1
5,830,058 A * 11/1998 Rosjo ..... A61G 13/108 454/187
6,681,848 B2 * 1/2004 Breeden ..... G05D 23/1917 165/238
7,185,504 B2 * 3/2007 Kasai ..... F24F 1/0007 62/186
8,103,384 B2 * 1/2012 Matsumoto ..... F24F 11/30 700/276
8,249,751 B2 * 8/2012 Takagi ..... F24F 11/30 700/278
8,392,026 B2 * 3/2013 Matsumoto ..... F24F 11/30 700/276
8,600,561 B1 * 12/2013 Modi ..... G05D 23/19 700/276
8,809,789 B2 * 8/2014 Matsumoto ..... F24F 11/30 250/353
8,826,678 B2 * 9/2014 Nakagawa ..... 62/177
2006/0201168 A1 * 9/2006 Kates ..... F24F 11/30 62/129
2008/0207109 A1 * 8/2008 Bagwell ..... F24F 1/0059 454/237
2012/0174608 A1 * 7/2012 Kumamoto ..... F24F 11/72 62/186
2012/0288363 A1 * 11/2012 Yumoto ..... F24F 13/14 415/182.1
2015/0013365 A1 * 1/2015 Yabuta ..... G05D 23/1931 62/190
2016/0201936 A1 7/2016 Suhara et al.
2016/0231015 A1 8/2016 Kumamoto et al.

FOREIGN PATENT DOCUMENTS

| | | | |
|---|---|---|---|
| EP | 2 530 395 | A1 | 12/2012 |
| GB | 2517023 | A | 2/2015 |
| JP | H03-255841 | A | 11/1991 |
| JP | H09-189456 | A | 7/1997 |
| JP | H10-339496 | A | 12/1998 |
| JP | 2011-038652 | A | 2/2011 |
| JP | 2011-208857 | A | 10/2011 |
| JP | 2013-50239 | A | 3/2013 |
| JP | 2014-126302 | A | 7/2014 |
| JP | 2015-064119 | A | 4/2015 |
| JP | 2015-232439 | A | 12/2015 |
| WO | 2011/093205 | A1 | 8/2011 |

OTHER PUBLICATIONS

Extended European Search Report dated May 7, 2018 issued in corresponding EP patent application No. 16900771.3.
Office Action dated Dec. 21, 2018 issued in corresponding EP patent application No. 16900771.3.
Office Action dated Sep. 3, 2019 issued in corresponding JP patent application No. 2018-533340 (and English translation).
Office Action dated Apr. 20, 2020 issued in corresponding CN patent application No. 201680088293.0 (and English translation).

* cited by examiner

AIR-CONDITIONING APPARATUS

CROSS REFERENCE TO RELATED APPLICATION

This application is a U.S. national stage application of PCT/JP2016/073434 filed on Aug. 9, 2016, the contents of which are incorporated herein by reference.

TECHNICAL FIELD

The present invention relates to an air-conditioning apparatus capable of performing a heating operation. In particular, the present invention relates to control related to an automatic heating operation.

BACKGROUND ART

An air-conditioning apparatus is known that is installed on the inside of a room serving as an air-conditioned space and has a function of preventing condensation on wall surfaces by performing a heating operation to raise temperatures of the wall surfaces, based on an indoor temperature, an indoor relative humidity level, and a wall-surface temperature that are detected (see Patent Literature 1, for example).

CITATION LIST

Patent Literature

Patent Literature 1: Japanese Unexamined Patent Application Publication No. 10-339496

SUMMARY OF INVENTION

Technical Problem

To prevent condensation inside a room, for example, it is necessary to calculate a dew point temperature and to perform an air-conditioning operation so that locations that may have condensation such as wall surfaces do not become colder than the dew point temperature. On the other hand, for example, for preventing the user inside the room from suffering from hypothermia due to the temperature inside the room being too low, it is necessary to maintain the temperature inside the room to be equal to or higher than such a threshold temperature under which the user suffers from hypothermia.

To protect the user by, for example, preventing the user from suffering from hypothermia, it is necessary to configure an air-conditioning apparatus to be able to start a heating operation by determining situations where the heating operation is necessary and to be able to determine whether or not the heating operation should be ended, without receiving instructions from the user.

To solve the problem described above, an object of the present invention is to provide an air-conditioning apparatus capable of performing a heating operation to protect the user.

Solution to Problem

An air-conditioning apparatus according to an embodiment of the present invention includes: a heating device configured to perform a heating operation by heating air inside a room and sending out the heated air; a floor temperature sensor configured to measure a floor temperature inside the room; a suction air temperature sensor configured to measure a suction air temperature that is a temperature of the air flowing into the heating device; and a controller configured to calculate a reference temperature from the floor temperature and the suction air temperature, and when determining that the reference temperature is lower than a start determination temperature designated in advance, cause the heating device to perform the heating operation.

Advantageous Effects of Invention

The air-conditioning apparatus according to the one embodiment of the present invention is configured to control the heating device to start performing the heating operation, based on the reference temperature calculated from the floor temperature and the suction air temperature. It is therefore possible to maintain the temperature inside the room measured in the vicinity of the user or a human-sensed temperature, for example, to be at such a level that does not cause hypothermia. Accordingly, the air-conditioning apparatus is able to automatically perform the heating operation intended for protecting the user.

DESCRIPTION OF EMBODIMENTS

Embodiment 1

Figure 1:
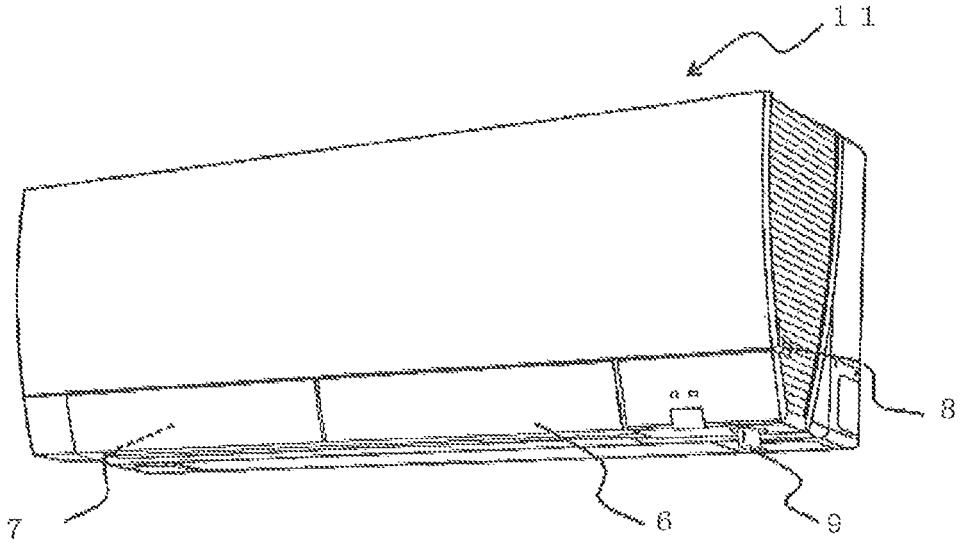
FIG. 1 is a drawing illustrating an exterior appearance of an indoor unit 11 of an air-conditioning apparatus 10 according to Embodiment 1 of the present invention.

Embodiments of an air-conditioning apparatus according to the present invention will be described hereinafter with reference to the drawings and other information. In the drawings referenced below, some of the constituent elements having the same reference characters are either the same elements or corresponding elements. The same applies throughout the embodiments presented below. Further, the modes of the constituent elements described in the present disclosure are merely examples. The present invention is not limited to the modes described in the present disclosure. In particular, possible combinations of the constituent elements are not limited to those described in the embodiments presented below. It is possible to apply the constituent elements described in each of the embodiments to any other embodiment. Further, in the explanations below, the top of the drawing pages will be referred to as an "upper side", while the bottom of the drawing pages will be referred to as a "lower side". Further, to make it easier to understand the configurations, some terms of directions (e.g., "right", "left", "front", "rear", and so on) will be used as appropriate. However, these terms are used for explanation purpose only and are not intended to limit the invention of the present disclosure. Further, the up-and-down direction as the air-conditioning apparatus is viewed from the front (the front face) side thereof will be referred to as a vertical direction, whereas the left-and-right direction will be referred to as a horizontal direction. In addition, as for the levels of pressure and temperature, the levels each being high or low is not defined based on a relationship with a particular absolute value; rather, the levels are determined in a relative manner in accordance with the state or operations of the devices and other elements. Further, the dimensional relationships among the constituent elements in the drawings may differ from relationships in actuality.

FIG. 1 is a drawing illustrating an exterior of an indoor unit 11 of an air-conditioning apparatus 10 according to Embodiment 1 of the present invention. It is assumed that the indoor unit 11 of Embodiment 1 is a wall-hung-type indoor unit installed on a wall surface. However, the type of the indoor unit 11 is not limited. An up-and-down airflow direction louver 6 is installed at an air outlet (not illustrated) and is configured to adjust the blowing direction of the air sent out from the indoor unit 11 in terms of the vertical direction (the up-and-down direction). Further, a left-and-right airflow direction louver 7 is configured to adjust the blowing direction of the air sent out from the indoor unit 11 in terms of the horizontal direction (the left-and-right direction). A suction air temperature sensor 8 is configured to detect the temperature of the air inside the room flowing into the indoor unit 11 as a suction air temperature Tb.

Figure 2:
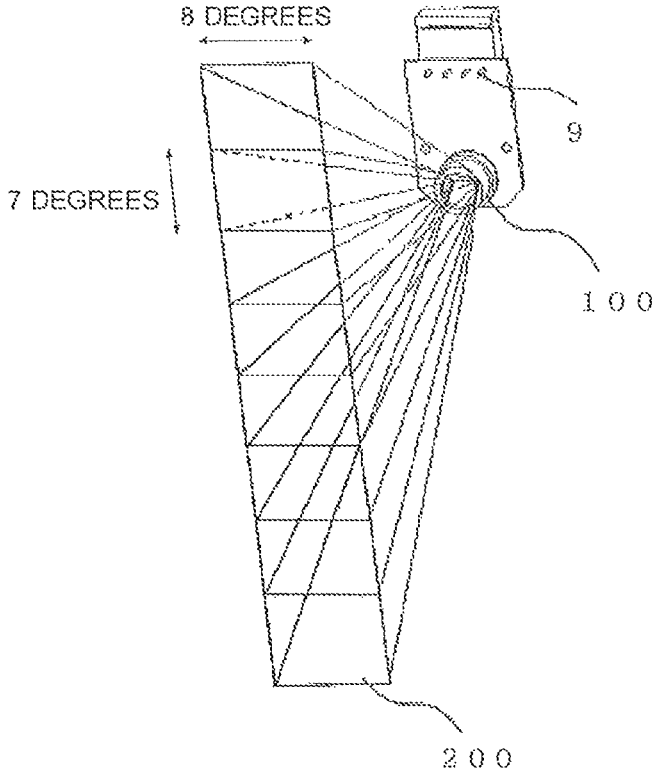
FIG. 2 is a drawing for explaining an infrared sensor 9 according to Embodiment 1 of the present invention.

FIG. 2 is a drawing for explaining an infrared sensor 9 according to Embodiment 1 of the present invention. The infrared sensor 9 according to Embodiment 1 is attached to the lower surface side of the indoor unit 11 at such an angle that the light receiving surface thereof is oriented downward (e.g., forming an angle of depression of approximately 24.5 degrees) with respect to a horizontal plane. Further, the infrared sensor 9 according to Embodiment 1 is structured, for example, by arranging eight light receiving elements (not illustrated) in a row in a vertical direction on the inside of a metal container 100. Further, the metal container 100 is provided with a window structured with a lens (not illustrated) that passes infrared rays to be received by one or more of the eight light receiving elements. The light distribution viewing angles 200 of each of the light receiving elements may be, for example, 7 degrees in the vertical direction and 8 degrees in the horizontal direction. The light distribution viewing angles 200 define the range in which each of the light receiving elements is able to receive the infrared rays. In the present example, the light distribution viewing angles 200 of each of the light receiving elements are assumed to be 7 degrees in the vertical direction and 8 degrees in the horizontal direction; however, possible configurations of the light distribution viewing angles 200 are not limited to those defined with 7 degrees in the vertical direction and 8 degrees in the horizontal direction. The quantity of the light receiving elements may vary in accordance with the light distribution viewing angles 200 of each of the light receiving elements. For example, a configuration is applicable in which a product calculated by multiplying the light distribution viewing angle 200 in the vertical direction of each of the light receiving elements by the quantity of the light receiving elements is constant.

Further, the infrared sensor 9 according to Embodiment 1 is positioned in such a range that the light distribution viewing angle 200 of at least one of the light receiving elements makes it possible to receive an infrared ray coming in the direction from the floor surface. For this reason, the infrared sensor 9 functions as a floor temperature sensor capable of detecting a floor temperature Ta inside the room.

Figure 3:
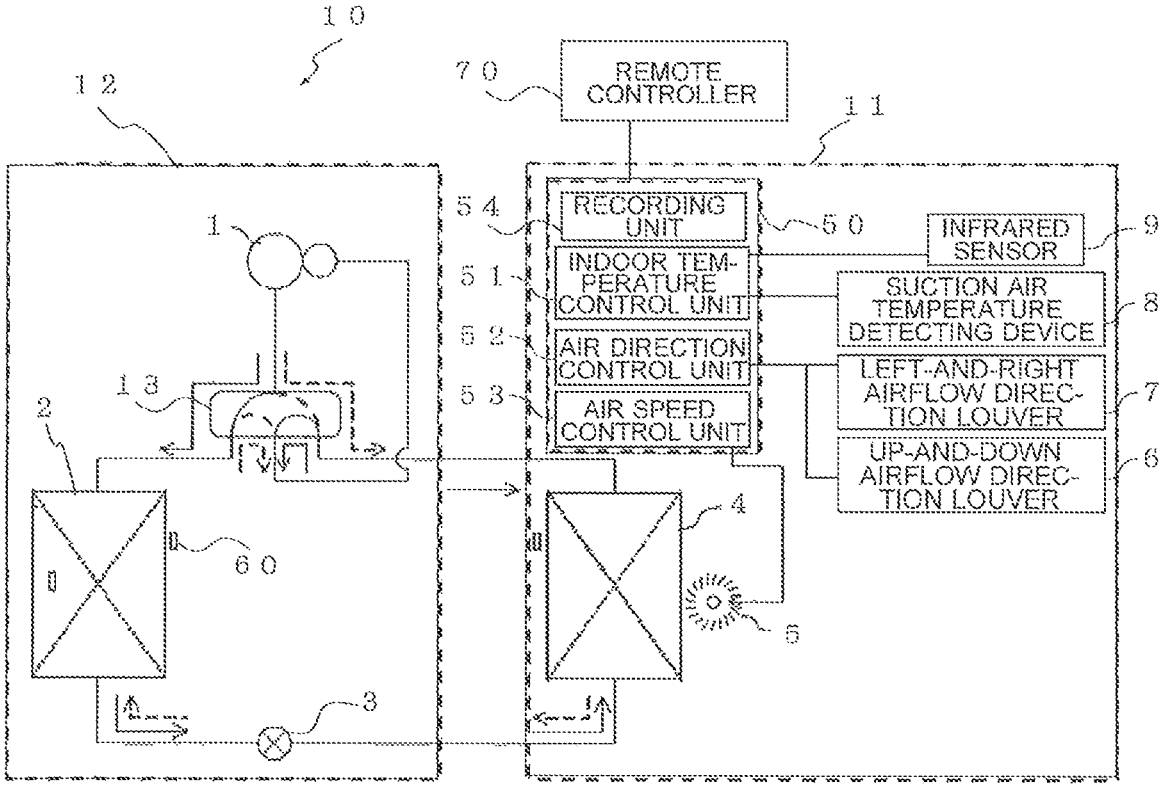
FIG. 3 is a drawing illustrating a configuration of the air-conditioning apparatus 10 according to Embodiment 1 of the present invention.

FIG. 3 is a drawing illustrating a configuration of the air-conditioning apparatus 10 according to Embodiment 1 of the present invention. As illustrated in FIG. 3, in the air-conditioning apparatus 10 according to Embodiment 1, an outdoor unit 12 and the indoor unit 11 are connected to each other by refrigerant pipes. More specifically, a refrigerant circuit is structured by connecting together a compressor 1, a flow switching device 13, an outdoor heat exchanger 2, an expansion valve 3, and an indoor heat exchanger 4, by using refrigerant pipes.

The outdoor unit 12 includes the compressor 1, the flow switching device 13, the outdoor heat exchanger 2, and the expansion valve 3. The compressor 1 is configured to compress refrigerant sucked therein and to discharge the compressed refrigerant. For example, by controlling the rotation speed of a compressor motor with the use of an inverter device (not illustrated) or another element, it is possible to vary the capacity (the amount of refrigerant that is output per unit time period) of the compressor 1. Further, the flow switching device 13 structured with a four-way valve or another element is a valve configured to switch the flow of the refrigerant in the refrigerant circuit between during a cooling operation and during a heating operation, for example.

The outdoor heat exchanger 2 is configured to exchange heat between the refrigerant and air (outdoor air). For example, during the heating operation, the outdoor heat exchanger 2 functions as an evaporator configured to evaporate and gasify the refrigerant. In contrast, during the cooling operation, the outdoor heat exchanger 2 functions as a condenser configured to condense and liquefy the refrigerant. In the present example, an example will be explained in which the outdoor heat exchanger 2 functions as a condenser; however, the outdoor heat exchanger 2 may be configured to function as a radiator radiating heat of the refrigerant. The expansion valve 3 structured with a limiting device, a flow rate control unit, or another element is configured to reduce the pressure and expand the refrigerant. For example, when the expansion valve 3 is structured by using an electronic expansion valve or a similar element, the opening degree thereof is regulated according to an instruction from a controller 50 (explained later) or another device.

Further, the indoor unit 11 includes the indoor heat exchanger 4 and a fan 5. The indoor heat exchanger 4 is configured to exchange heat, for example, between the air inside the room to be air-conditioned and the refrigerant. During the heating operation, the indoor heat exchanger 4 functions as a condenser configured to condense and liquefy the refrigerant. In the present example, an example will be explained in which the indoor heat exchanger 4 functions as a condenser; however, the indoor heat exchanger 4 may be configured to function as a radiator radiating heat of the refrigerant. In contrast, during the cooling operation, the indoor heat exchanger 4 functions as an evaporator configured to evaporate and gasify the refrigerant. The fan 5 is configured to form an airflow so that the air inside the room flows into the indoor unit 11 through an air inlet, passes through the indoor heat exchanger 4, and flows out of the indoor unit 11 through the air outlet. In the present example, during the heating operation, the indoor unit 11 functions as a heating device.

The controller 50 is configured to control the air-conditioning apparatus 10. In Embodiment 1, the controller 50 includes an indoor temperature control unit 51, an air direction control unit 52, an air speed control unit 53, and a recording unit 54. The indoor temperature control unit 51 is configured to adjust the temperature inside the room by performing an air-conditioning operation controlling the devices constituting the refrigerant circuit. The air direction control unit 52 is configured to adjust the air blowing direction from the indoor unit 11, by controlling the up-and-down airflow direction louver 6 and the left-and-right airflow direction louver 7. The air speed control unit 53 is configured to adjust the air speed of the air sent out from the indoor unit 11, by controlling the rotation speed of the fan. The recording unit 54 is configured to record data and other information that are necessary for the controller 50 to perform control.

Further, the air-conditioning apparatus 10 includes an outdoor air temperature sensor (60) 60 serving as a device to detect an outdoor air temperature. The outdoor air temperature sensor (60) 60 is a device installed within the outdoor unit 12 and configured to detect the temperature on the outside of the room as the outdoor air temperature. A remote controller 70 serves as an input device configured, for example, to transmit signals including data related to operation instructions input by the user such as starting and stopping the operation of the air-conditioning apparatus 10, setting a desired temperature, an operation mode (cooling/heating), and other designations. Further, the remote controller 70 also serves as a device configured to receive and display signals including data indicating an operating state of the air-conditioning apparatus 10, the signals being sent thereto from the controller 50.

Next, operations of the air-conditioning apparatus 10 according to Embodiment 1 will be explained based on flows of the refrigerant. First, the cooling operation will be explained. In FIG. 3, the flow of the refrigerant during the cooling operation is indicated with solid-line arrows. Having been compressed by the compressor 1 and discharged, the gas refrigerant having high temperature and high pressure passes through the flow switching device 13 and flows into the outdoor heat exchanger 2. After that, passing through the outdoor heat exchanger 2 and been condensed and liquefied as a result of the heat exchange process with the outdoor air, the refrigerant (liquid refrigerant) flows into the expansion valve 3. The pressure of the refrigerant is reduced by the expansion valve 3, and the refrigerant, which is now in a two-phase gas-liquid state, flows out of the outdoor unit 12.

The two-phase gas-liquid refrigerant flowing out of the outdoor unit 12 passes through the refrigerant pipe, flows into the indoor unit 11, and passes through the indoor heat exchanger 4. After that, having been evaporated and gasified as a result of the heat exchange process with the air in the indoor space, for example, the refrigerant (gas refrigerant) flows out of the indoor unit 11.

The gas refrigerant flowing out of the indoor unit 11 passes through the refrigerant pipe and flows into the outdoor unit 12. After that, the refrigerant passes through the flow switching device 13 and is sucked into the compressor 1 again. In the manner described above, the inside of the room is cooled as a result of the refrigerant of the air-conditioning apparatus circulating.

Next, the heating operation will be explained based on flows of the refrigerant. In FIG. 3, the flow of the refrigerant during the heating operation is indicated with broken-line arrows. Having been compressed by the compressor 1 and discharged, the gas refrigerant having high temperature and high pressure passes through the flow switching device 13 and flows out of the outdoor unit 12. Having flowed out of the outdoor unit 12, the gas refrigerant passes through the refrigerant pipe and flows into the indoor unit 11. After that, having been condensed and liquefied as a result of the heat exchange process with the air in the indoor space while going through the indoor heat exchanger 4, for example, the refrigerant flows out of the indoor unit 11.

Having flowed out of the indoor unit 11, the refrigerant passes through the refrigerant pipe and flows into the outdoor unit 12. After that, the pressure of the refrigerant is reduced by the expansion valve 3, and the refrigerant, which is now in a two-phase gas-liquid state, flows into the outdoor heat exchanger 2. After that, the refrigerant (gas refrigerant) passing through the outdoor heat exchanger 2 and having been evaporated and gasified as a result of the heat exchange process with the outdoor air passes through the flow switching device 13 and is sucked into the compressor 1 again. In the manner described above, the inside of the room is heated as a result of the refrigerant of the air-conditioning apparatus circulating.

Figure 4:
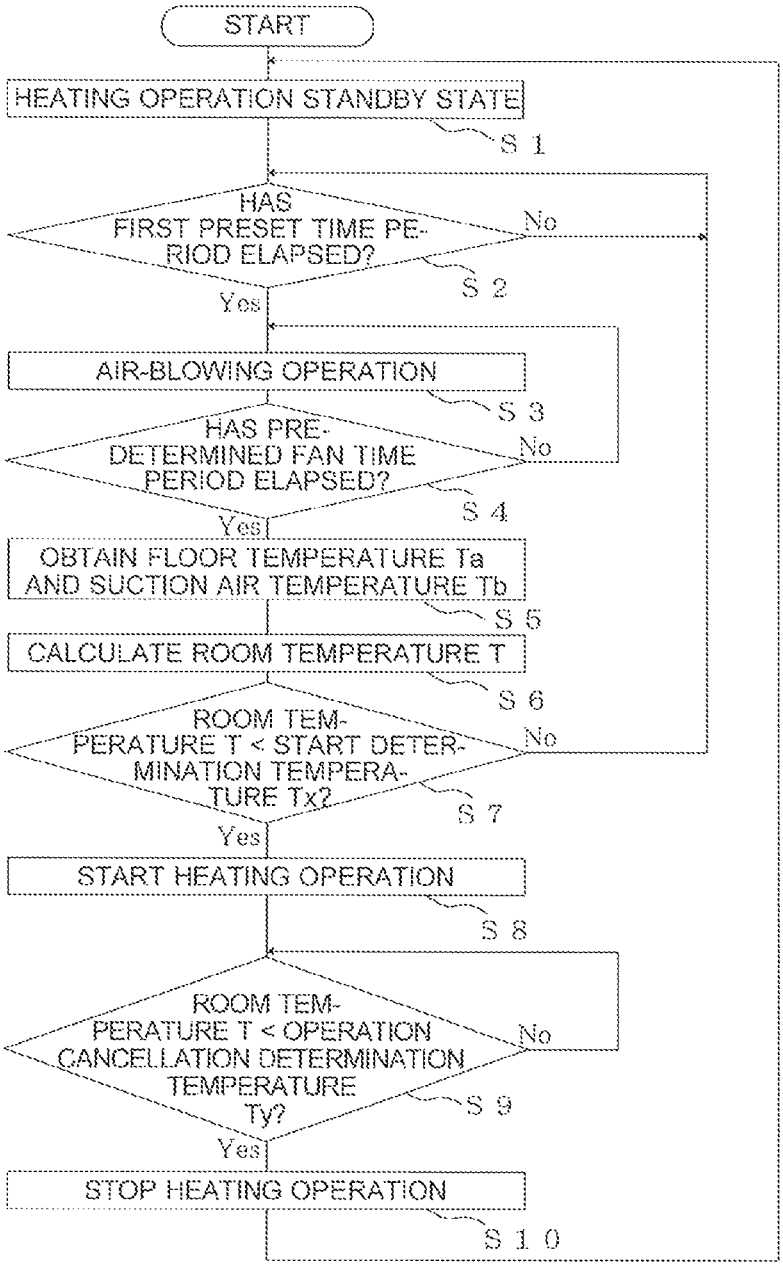
FIG. 4 is a drawing of a flowchart for explaining an operation related to an automatic heating operation performed by the air-conditioning apparatus 10 according to Embodiment 1 of the present invention.

FIG. 4 is a drawing of a flowchart for explaining an operation related to an automatic heating operation performed by the air-conditioning apparatus 10 according to Embodiment 1 of the present invention. With reference to FIG. 4, the operation related to the automatic heating operation performed by the air-conditioning apparatus 10 according to Embodiment 1 will be explained.

For example, while the operation of the air-conditioning apparatus 10 is stopped, when an instruction is input to the remote controller 70 to set an automatic heating operation mode in which the temperature inside the room or a human-sensed temperature are monitored so as not to be too low for the purpose of preventing hypothermia, the controller 50 brings the air-conditioning apparatus 10 into a heating operation standby state (step S1). In the standby state, the fan 5 is not turned on. In this situation, to prevent the fan 5 from being turned on, the air direction control unit 52 may control the up-and-down airflow direction louver 6 to be in a position corresponding to an OFF state or may control the up-and-down airflow direction louver 6 to be in a position corresponding to an ON state.

Further, it is determined whether or not a first preset time period (e.g., 30 minutes) that is designated in advance has elapsed since the air-conditioning apparatus 10 went into the standby state (step S2). When it is determined that the first preset time period has not elapsed, the air-conditioning apparatus 10 is kept in the standby state.

On the other hand, when it is determined at step S2 that the first preset time period has elapsed, an air-blowing operation is performed (step S3). During the air-blowing operation, the fan 5 is turned on. In this situation, because the air inside the room flows into the indoor unit 11, the suction air temperature sensor 8 is able to detect the suction air temperature Tb. During the air-blowing operation, to have the fan 5 turned on, the air direction control unit 52 controls the up-and-down airflow direction louver 6 to be in the same position as that in the ON state. In this situation, because the air-blowing operation is performed once every first preset time period, it is also possible to configure the up-and-down airflow direction louver 6 to be in the position corresponding to the ON state even after the air-blowing operation is finished and the air-conditioning apparatus 10 has returned to the standby state. By arranging the up-and-down airflow direction louver 6 to be in the position corresponding to the ON state, it is possible, when the air-blowing operation is performed next time, to cause the air-conditioning apparatus 10 to transition from the standby state into the air-blowing operation, without the need to move the up-and-down airflow direction louver 6.

It is determined whether or not a predetermined air-blowing time period (e.g., 3 minutes) has elapsed since the air-blowing operation was started (step S4). When it is determined that the predetermined air-blowing time period has not elapsed, the fan operating state is maintained to continue. In contrast, when it is determined that the predetermined air-blowing time period has elapsed, the floor temperature Ta detected by the infrared sensor 9 and the suction air temperature Tb detected by the suction air temperature sensor 8 are obtained (step S5).

From the suction air temperature Tb and the floor temperature Ta, the controller 50 calculates a room temperature T serving as a reference temperature used for making determination related to the automatic heating operation (step S6). For example, because the wall-hung-type indoor unit 11 is usually installed in an upper section of the inside of the room, the suction air temperature Tb detected by the suction air temperature sensor 8 is the temperature of the air in the upper section of the inside of the room. However, in some situations, a temperature difference may occur between the temperature in the upper section of the inside of the room and the temperature in the position where the user is present. In general, due to the difference in density of the air caused by the different levels of temperature, the temperature of the air in a lower section of the room is lower than the temperature of the air in the upper section of the room. For this reason, the room temperature T closer to the temperature of the air in the vicinity of the user is calculated as the temperature inside the room, by correcting the suction air temperature Tb with the floor temperature Ta resulting from the detection by the infrared sensor 9.

As an example of a procedure to calculate the room temperature T, a method for calculating the room temperature T will be explained by which a correction amount is added to the suction air temperature Tb, the correction amount being calculated by multiplying the difference (Ta−Tb) between the floor temperature Ta and the suction air temperature Tb by a weight coefficient (e.g., 0.5). For example, with the floor temperature Ta=8 [degrees C.] and the suction air temperature Tb=12 [degrees C.], the room temperature T=10 [degrees C.] is obtained, as a result of the calculation presented below:

$$\begin{aligned} T &= Tb + (Ta - Tb) \times 0.5 \\ &= 12 + (8 - 12) \times 0.5 \\ &= 10 \text{ [degrees C]} \end{aligned}$$

Subsequently, it is determined whether or not the room temperature T is lower than a start determination temperature Tx (e.g., 12 degrees C.) that is designated in advance and serves as a first threshold temperature at which the heating operation should be started (step S7). When it is determined that the room temperature T is lower than the start determination temperature Tx, the air-conditioning apparatus 10 is caused to start the heating operation (step S8). In contrast, when it is determined that the room temperature T is not lower than the start determination temperature Tx, the air-blowing operation is stopped, for example, and the air-conditioning apparatus 10 stands by until the first preset time period elapses again (step S2).

During the heating operation at step S8, the air-conditioning apparatus 10 performs an operation to raise the room temperature T, to prevent the user from suffering from hypothermia. In this situation, for example, when the heating operation is started, the controller 50 may inform the user that the inside of the room is in a low temperature state, by turning a light on for a certain period of time in a display unit (not illustrated) that is included in the indoor unit 11 and has a LED or another element. Alternatively, the controller 50 may cause a display unit (not illustrated) such as the remote controller 70 to display a message indicating that the inside of the room is in a low temperature state, the display unit being configured to display the operating state of the indoor unit 11. Further, the controller 50 may inform the user that the inside of the room is in a low temperature state, by causing a sound device such as a buzzer to operate for a certain period of time, the sound device being included in the indoor unit 11, the remote controller, or another device.

In this situation, during the heating operation, as for the magnitude of the air speed of the fan 5 and the directions of the up-and-down airflow direction louver 6 and the left-and-right airflow direction louver 7, for example, the air direction control unit 52 and the air speed control unit 53 execute control in such a manner that a certain magnitude of air speed and certain directions of the airflow direction louvers are realized when an instruction is issued to start the automatic heating operation. For this reason, it is possible to perform the heating operation with such operation settings that were used when the user set the automatic heating operation and that have actually been used before and are therefore reliable. However, possible configurations are not limited to this example. For instance, when there is a more effective method for exercising control to raise the temperature inside the room (e.g., arranging the air speed to be high), the air-conditioning apparatus 10 may be controlled by using such a method.

Even during the heating operation, the indoor temperature control unit 51 calculates a room temperature T by using the floor temperature Ta and the suction air temperature Tb that are obtained. Further, it is determined whether or not the calculated room temperature T is higher than an operation cancellation determination temperature Ty (e.g., 14 degrees C.) that is designated in advance (step S9). When it is determined that the room temperature T is higher than the operation cancellation determination temperature Ty, the heating operation is stopped (step S10), and the air-conditioning apparatus 10 returns to the standby state (step S1). In contrast, when it is determined that the room temperature T is not higher than the operation cancellation determination temperature Ty, the heating operation is continued. The processes described above are continuously performed until the user cancels the automatic heating operation mode.

As explained above, when the air-conditioning apparatus 10 according to Embodiment 1 is used, because the controller 50 is capable of determining whether or not the automatic heating operation should be started and cancelled, based on the temperature close to the temperature sensed by the user as the temperature inside the room, it is possible to protect the user by more effectively lowering the possibility of suffering from hypothermia the user.

Embodiment 2

In Embodiment 1, it is determined whether the heating operation should be ended or not while using the room temperature T as the condition. The air-conditioning apparatus 10 according to Embodiment 2 is further configured to determine whether the heating operation should be ended or not, by additionally using the temperature of the outside air as a condition. As the temperature of the outside air, a temperature resulting from the detection by the outdoor air temperature sensor (60) 60 shall be used.

Figure 5:
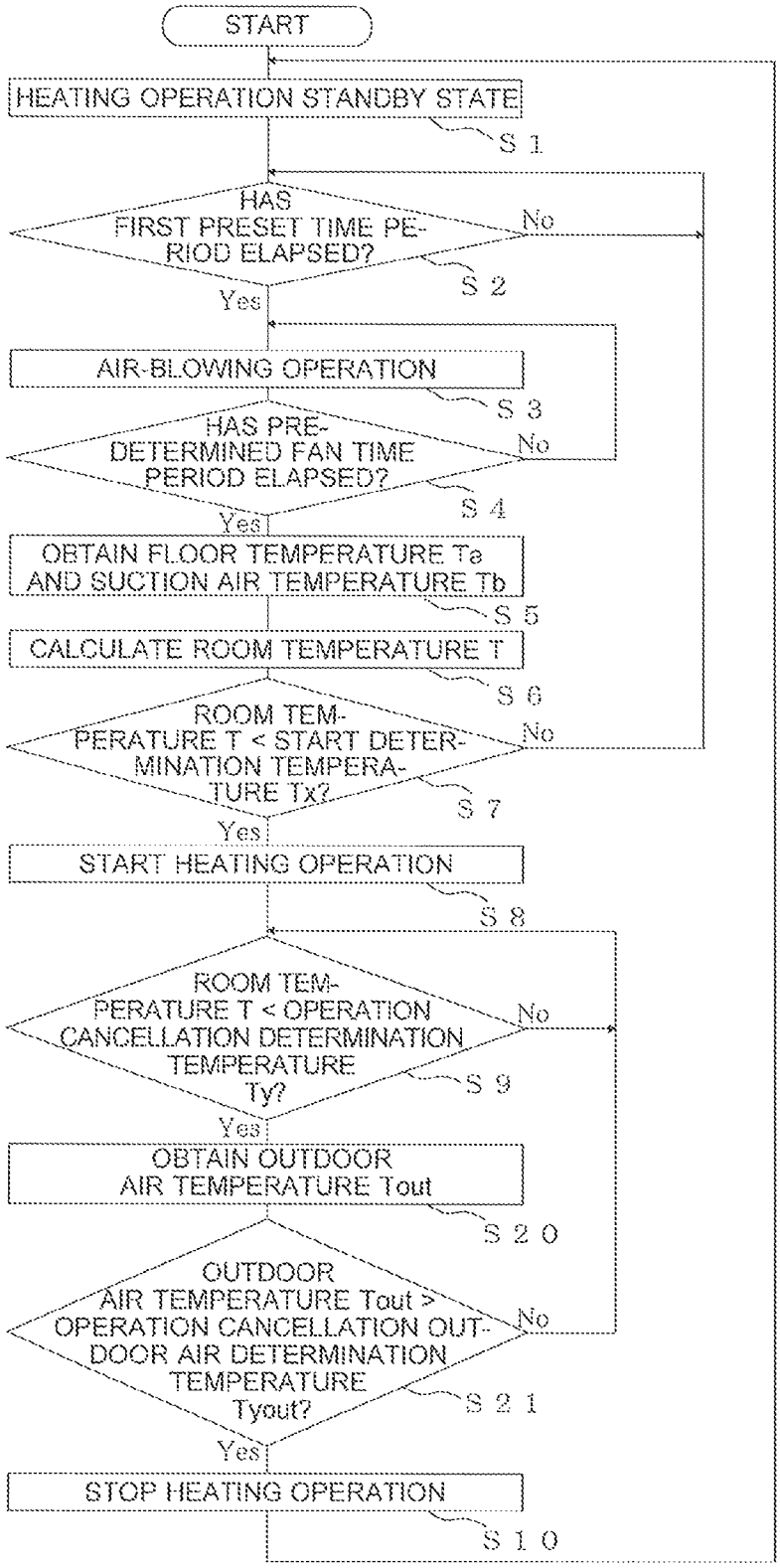
FIG. 5 is a drawing of a flowchart for explaining an operation related to an automatic heating operation performed by the air-conditioning apparatus 10 according to Embodiment 2 of the present invention.

FIG. 5 is a drawing of a flowchart for explaining an operation related to an automatic heating operation performed by the air-conditioning apparatus 10 according to Embodiment 2 of the present invention, With reference to FIG. 5, operations related to the automatic heating operation performed by the air-conditioning apparatus 10 according to Embodiment 2 will be explained. In the present example, some of the steps referred to by using the same reference numerals as those in FIG. 4 have the same processes performed as those explained in Embodiment 1.

The indoor temperature control unit 51 judges, also during the heating operation, whether or not the calculated room temperature T is higher than the operation cancellation determination temperature Ty designated in advance (step S9). When the indoor temperature control unit 51 determines that the room temperature T is not higher than the operation cancellation determination temperature Ty, the heating operation keeps being performed.

In contrast, when determining that the room temperature T is higher than the operation cancellation determination temperature Ty, the indoor temperature control unit 51 obtains an outdoor air temperature Tout detected by the outdoor air temperature sensor (60) 60 (step S20). Further, the indoor temperature control unit 51 judges whether or not the outdoor air temperature Tout is higher than an operation cancellation outdoor air determination temperature Tyout that is set in advance (step S21). When determining that the outdoor air temperature Tout is higher than the operation cancellation outdoor air determination temperature Tyout, the indoor temperature control unit 51 stops the heating operation (step S10), and the air-conditioning apparatus 10 returns to the standby mode (step S1). In contrast, when determining that the outdoor air temperature Tout is not higher than the operation cancellation outdoor air determination temperature Tyout, the heating operation keeps being performed.

As explained above, when the air-conditioning apparatus 10 according to Embodiment 2 is used, the indoor temperature control unit 51 is configured to end the heating operation by using, as the conditions, not only whether or not the room temperature T is higher than the operation cancellation determination temperature Ty, but also whether or not the outdoor air temperature Tout is higher than the operation cancellation outdoor air determination temperature Tyout. With this arrangement, for example, it is possible to avoid the situation where, after the heating operation is stopped, the temperature inside the room immediately drops due to a low outdoor air temperature and the heating operation is started again. Accordingly, it is possible to perform the heating operation capable of protecting the user, by more effectively lowering the possibility of the user suffering from hypothermia.

Embodiment 3

The air-conditioning apparatus 10 according to Embodiment 3 is configured to determine whether or not the air-conditioning apparatus 10 should perform the automatic heating operation, by determining whether or not the most recent operation resulting from an instruction from the user was the heating operation. In the present example, it is assumed that data indicating the operation mode instructed by the user is recorded in the recording unit 54.

Figure 6:
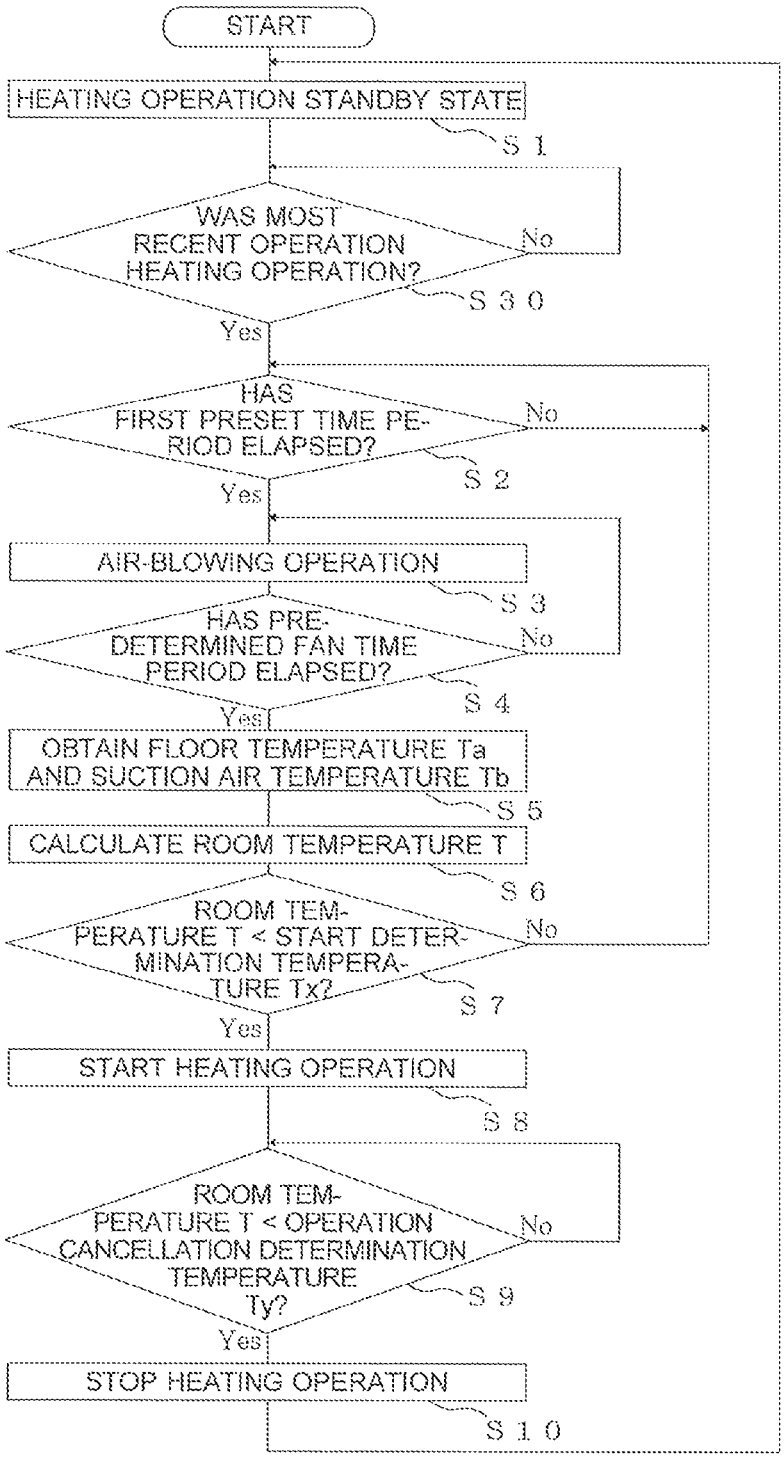
FIG. 6 is a drawing of a flowchart for explaining an operation related to an automatic heating operation performed by the air-conditioning apparatus 10 according to Embodiment 3 of the present invention.

FIG. 6 is a drawing of a flowchart for explaining an operation related to an automatic heating operation performed by the air-conditioning apparatus 10 according to Embodiment 3 of the present invention. With reference to FIG. 6, the operation related to the automatic heating operation performed by the air-conditioning apparatus 10 according to Embodiment 3 will be explained. In the present example, some of the steps referred to by using the same reference numerals as those in FIG. 4 have the same processes performed as those explained in Embodiment 1.

The controller 50 brings the air-conditioning apparatus 10 into the heating operation standby state (step S1). After that, it is determined whether or not the most recent operation mode resulting from an instruction from the user was the heating operation (step S30). Having determined that the most recent operation was the heating operation, it is determined, similarly to Embodiment 1, whether or not the first preset time period has elapsed (step S2), and the processes thereafter keep being performed.

At step S30, when it is determined that the most recent operation instructed by the user was not the heating operation, the process in the automatic heating operation mode is ended. Accordingly, when the air-conditioning apparatus 10 according to Embodiment 3 is used, it is possible to eliminate the possibility where, during summer season when the cooling operation is performed for example, the air-conditioning apparatus 10 is brought into the automatic heating operation mode to perform the air-blowing operation and the heating operation in vain. With this arrangement, for example, the air-conditioning apparatus 10 does not need to perform the air-blowing operation once every predetermined time period. It is therefore possible to prevent the air-conditioning apparatus 10 from consuming electric power wastefully. In this situation, for example, even when the most recent operation was the automatic heating operation, it is determined that the operation mode instructed latest was the heating operation. Accordingly, it is also acceptable to use the operation mode that was used latest for determining the most recent operation mode resulting from an instruction from the user.

Embodiment 4

In Embodiment 1, it is determined whether or not the heating operation should be ended, by using the room temperature T as the condition. The air-conditioning apparatus 10 according to Embodiment 4 is configured to determine whether or not the heating operation should be ended by using the room temperature T observed during thermo-off (hereinafter, "a thermo-off state") as a condition.

Figure 7:
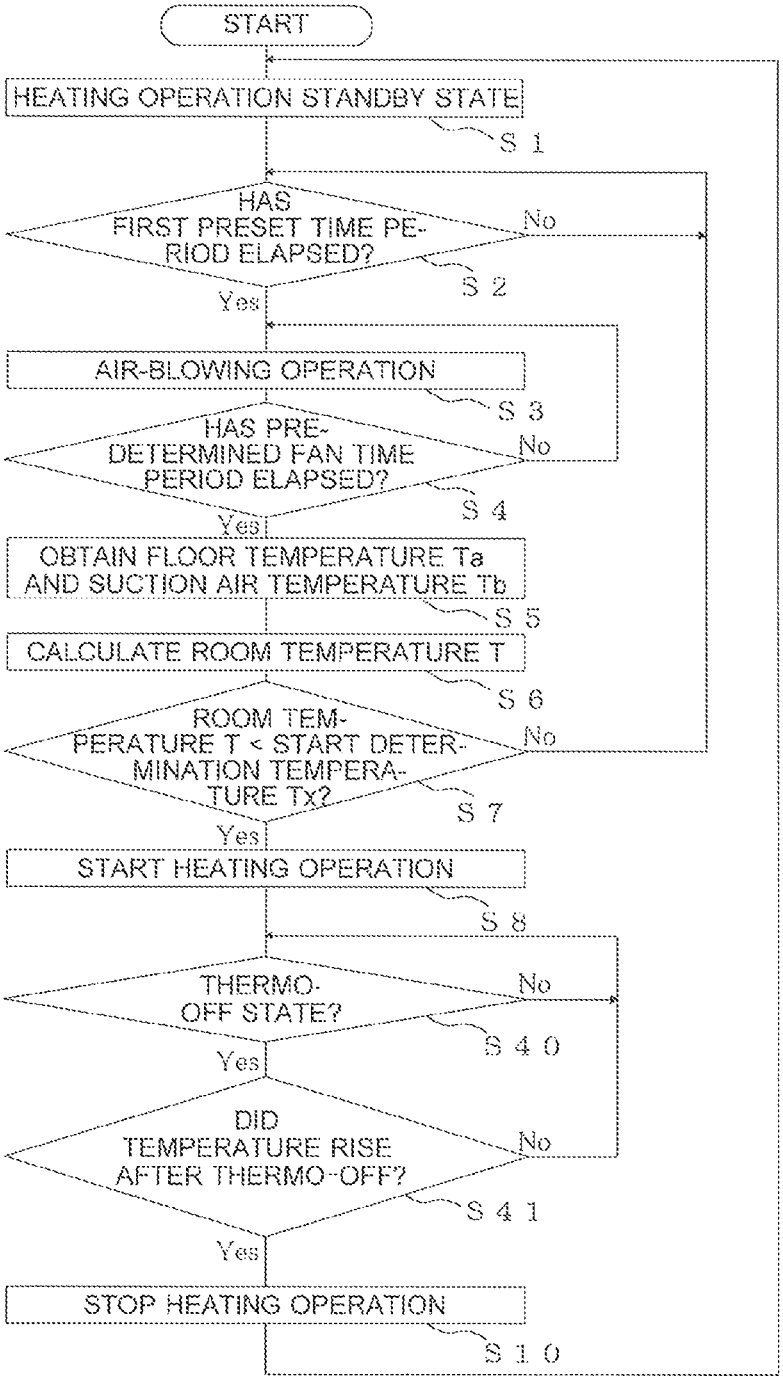
FIG. 7 is a drawing of a flowchart for explaining an operation related to an automatic heating operation performed by the air-conditioning apparatus 10 according to Embodiment 4 of the present invention.

FIG. 7 is a drawing of a flowchart for explaining an operation related to an automatic heating operation performed by the air-conditioning apparatus 10 according to Embodiment 4 of the present invention. With reference to FIG. 7, the operation related to the automatic heating operation performed by the air-conditioning apparatus 10 according to Embodiment 4 will be explained. In the present example, some of the steps referred to by using the same reference numerals as those in FIG. 4 have the same processes performed as those explained in Embodiment 1.

In Embodiment 4, when the indoor temperature control unit 51 causes the air-conditioning apparatus 10 to start the heating operation (step S8), the indoor temperature control unit 51 judges whether or not the air-conditioning apparatus 10 is in a thermo-off state (step S40). When it is determined that the air-conditioning apparatus 10 is not in a thermo-off state, the heating operation keeps being performed.

In contrast, when determining that the air-conditioning apparatus 10 is in a thermo-off state, the indoor temperature control unit 51 further judges whether or not the room temperature T has risen to be equal to or higher than a predetermined temperature designated in advance (step S41). When it is determined that the room temperature T has risen to be equal to or higher than the predetermined temperature, the heating operation is stopped (step S10), and the air-conditioning apparatus 10 returns to the standby state (step S1). In contrast, when it is determined that the room temperature T has not risen to be equal to or higher than the predetermined temperature, the heating operation keeps being performed.

As explained above, when the air-conditioning apparatus 10 according to Embodiment 4 is used, the heating operation is stopped when it is determined that the room temperature T rose after the thermo-off. With this arrangement, it is possible to avoid the situation where, when the heating operation is stopped, the temperature inside the room immediately drops and the heating operation is started again. Accordingly, it is possible to perform the heating operation capable of protecting the user, by more effectively lowering the possibility of the user suffering from hypothermia.

Embodiment 5

The air-conditioning apparatus 10 according to Embodiment 5 is provided with a human body sensor configured to detect one or more persons who are present in the room. In Embodiment 5, it is assumed that the infrared sensor 9 is also used as the human body sensor. It is possible to determine whether or not one or more persons are present in the room, based on the temperature detected by the infrared sensor 9. For example, it is possible to determine that one or more persons are present when a temperature close to the body temperature is among various temperature levels detected by the infrared sensor 9.

Figure 8:
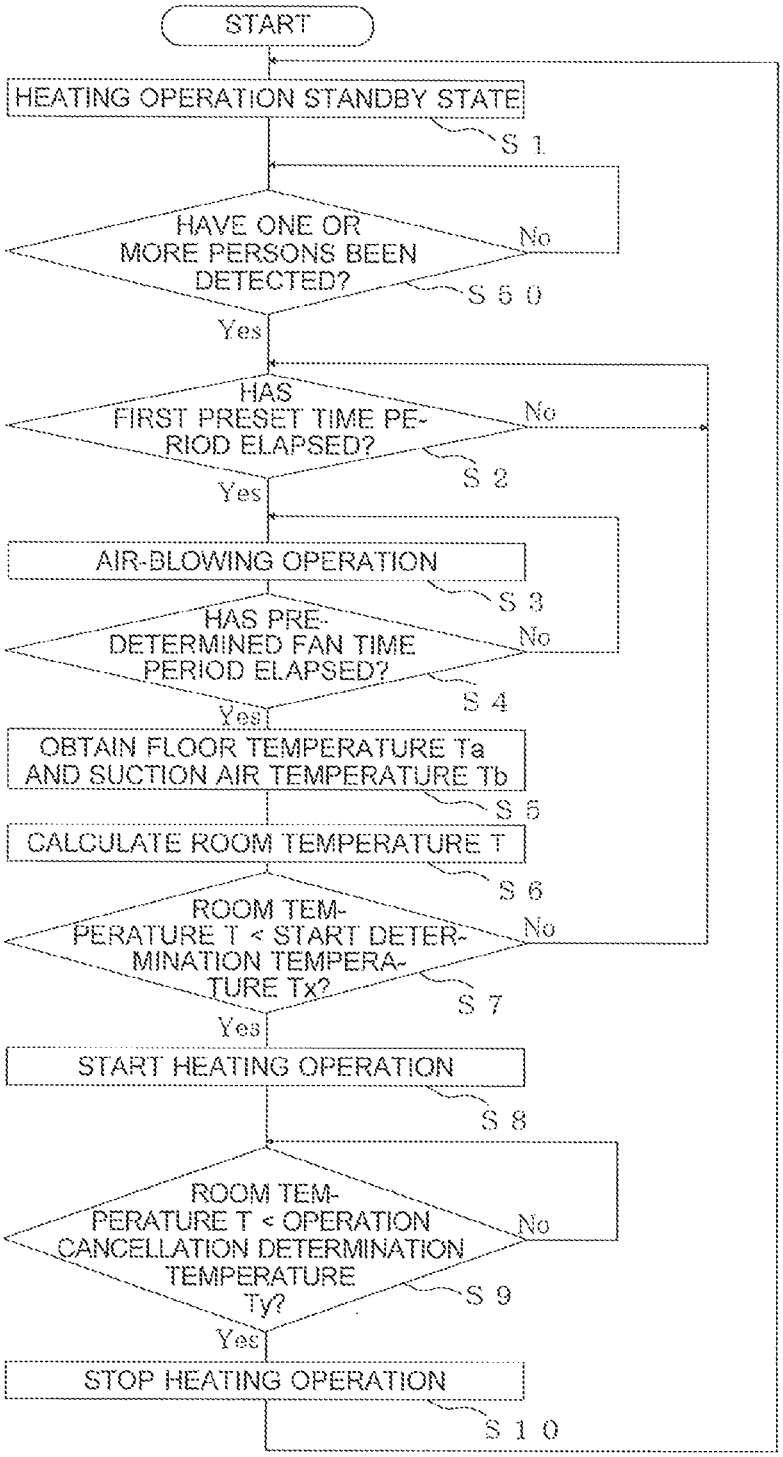
FIG. 8 is a drawing of a flowchart for explaining an operation related to an automatic heating operation performed by the air-conditioning apparatus 10 according to Embodiment 5 of the present invention.

FIG. 8 is a drawing of a flowchart for explaining an operation related to an automatic heating operation performed by the air-conditioning apparatus 10 according to Embodiment 5 of the present invention. With reference to FIG. 8, the operation related to the automatic heating operation performed by the air-conditioning apparatus 10 according to Embodiment 5 will be explained. In the present example, some of the steps referred to by using the same reference numerals as those in FIG. 4 have the same processes performed as those explained in Embodiment 1.

For example, when an instruction is input to set the air-conditioning apparatus 10 into the automatic heating operation mode for the purpose of preventing hypothermia, the controller 50 brings the air-conditioning apparatus 10 into the heating operation standby state (step S1), After that, the temperature detected by the infrared sensor 9 is obtained, to determine whether or not one or more persons are present in the room based on the temperature detected by the infrared sensor 9 (step S50). When it is determined that one or more persons are present, it is determined, similarly to Embodiment 1, whether or not the first preset time period has elapsed (step S2), and the processes thereafter keep being performed.

In contrast, when it s determined at step S50 that no person is present in the room, the determining process keeps being performed in which it is determined whether or not one or more persons are present in the room based on the temperature detected by the infrared sensor 9. With this arrangement, when no person is present in the room, the air-conditioning apparatus 10 does not need to perform the automatic heating operation for the purpose of preventing hypothermia. Accordingly, it is possible to eliminate the possibility of the air-conditioning apparatus 10 performing the air-blowing operation and the heating operation in vain. With this arrangement, for example, the air-conditioning apparatus 10 does not need to perform the air-blowing operation once every predetermined time period. It is therefore possible to prevent the air-conditioning apparatus 10 from consuming electric power wastefully. Although the infrared sensor 9 is used as the human body sensor in the present example, it is also acceptable to install a separate human body sensor besides the infrared sensor 9. Further, possible methods for detecting human bodies are not limited to methods using infrared rays.

Embodiment 6

In Embodiments 1 to 5, the example is explained in which the air-conditioning apparatus 10 including the refrigerant circuit and is configured to protect the user by performing the automatic heating operation while the indoor heat exchanger 4 is functioning as the condenser; however, possible embodiments are not limited to this example. For instance, as long as it is possible to heat the inside of the room, it is also acceptable to perform the automatic heating operation by controlling not only the indoor heat exchanger 4 functioning as the condenser, but also a heating device such as a heater.

Further, in Embodiments 1 to 5, the example is explained in which the determinations related to the automatic heating operation are made by calculating the room temperature T as the reference temperature; however, possible embodiments are not limited to this example. For instance, another arrangement is acceptable in which a human-sensed temperature of the user is calculated as a reference temperature, from the suction air temperature Tb and a radiant heat amount from the floor surface obtained based on the floor temperature Ta, to determine whether or not the automatic heating operation should be started and cancelled.

REFERENCE SIGNS LIST

1 compressor 2 outdoor heat exchanger 3 expansion valve 4 indoor heat exchanger 5 fan 6 up-and-down airflow direction louver 7 left-and-right airflow direction louver 8 suction air temperature sensor 9 infrared sensor 10 air-conditioning apparatus 11 indoor unit 12 outdoor unit 13 flow switching device 50 controller 51 indoor temperature control unit 52 air direction control unit 53 air speed control unit 54 recording unit 60 outdoor air temperature sensor (60) 70 remote controller 100 metal container 200 light distribution viewing angle

The invention claimed is:

1. An air-conditioning apparatus comprising:

a heating device configured to perform a heating operation by heating air inside a room and sending out the heated air;

a floor temperature sensor configured to measure a floor temperature inside the room;

a suction air temperature sensor configured to measure a suction air temperature that is a temperature of the air flowing into the heating device; and a controller configured to, when an automatic heating operation mode in which the heating operation is performed automatically is set and operation of the air-conditioning apparatus is stopped, bring the air-conditioning apparatus into a heating operation standby state in which a fan is not operating, and after a first preset time period has elapsed during the heating operation standby state, cause the fan to operate, and after the fan is operating:

calculate a reference temperature from the floor temperature and the suction air temperature, and when determining that the reference temperature is lower than a start determination temperature designated in advance, cause the heating device to start the heating operation.

2. The air-conditioning apparatus of claim 1, further comprising:

a recording device configured to record an operation performed latest, wherein the controller is further configured to, when determining that the reference temperature is lower than the start determination temperature and that the latest performed operation recorded by the recording device is the heating operation, cause the heating device to perform the heating operation.

3. The air-conditioning apparatus of claim 1, further comprising:

a human body sensor configured to detect whether at least one person is present in the room, wherein the controller is further configured to, when determining that the reference temperature is lower than the start determination temperature and that the human body sensor has detected the at least one person, cause the heating device to perform the heating operation.

4. The air-conditioning apparatus of claim 1, wherein the controller is further configured to, when determining that the reference temperature observed after the heating operation is started is higher than an operation cancellation determination temperature designated in advance, stop the heating operation.

5. The air-conditioning apparatus of claim 4, further comprising:

an outdoor air temperature sensor configured to measure an outdoor air temperature that is a temperature outside the room, wherein the controller is further configured to, when determining that the reference temperature observed after the heating operation is started is higher than the operation cancellation determination temperature and that the outdoor air temperature is higher than an operation cancellation outdoor air determination temperature designated in advance, stop the heating operation.

6. The air-conditioning apparatus of claim 1, wherein the controller is further configured to, when determining that the reference temperature observed during a thermo-off state after the heating operation is started has risen to be greater than or equal to a first temperature, stop the heating operation and return to the heating operation standby state.

7. The air-conditioning apparatus of claim 1, wherein the reference temperature is a temperature inside the room.

8. The air-conditioning apparatus of claim 1, wherein the reference temperature is a human-sensed temperature.

9. The air-conditioning apparatus of claim 1, wherein the heating device includes at least a condenser of a refrigerant circuit structured by connecting together a compressor, the condenser, a pressure reducing device, and an evaporator by using a pipe.

10. The air-conditioning apparatus of claim 1, further comprising a fan, wherein the controller is further configured to cause the fan to operate for a preset time period when a preset time elapses in the heating operation standby state, and calculate the reference temperature based on the floor temperature observed after the fan is operated for the preset time period and the suction air temperature observed after the fan is operated for the preset time period.

* * * * *